United States Patent [19]

Salomon et al.

[11] Patent Number: 4,909,952

[45] Date of Patent: Mar. 20, 1990

[54] SULFUR-CONTAINING POLYMERIC POLYESTERS AND ADDITIVE CONCENTRATES AND LUBRICATING OILS CONTAINING SAME

[75] Inventors: Mary F. Salomon, Cleveland Heights; Richard M. Lange, Euclid, both of Ohio

[73] Assignee: The Lubrizol Corporation, Wickliffe, Ohio

[21] Appl. No.: 292,702

[22] Filed: Jan. 3, 1989

[51] Int. Cl.[4] ..... C10M 157/06

[52] U.S. Cl. ..... 252/48.6; 252/47.5; 560/154

[58] Field of Search ..... 252/47.5, 48.6; 560/154

[56] References Cited

U.S. PATENT DOCUMENTS

| | | | |
|---|---|---|---|
| 2,520,748 | 8/1950 | Vaughan et al. | 252/48.6 |
| 2,540,570 | 2/1951 | Cyphers | 252/46.6 |
| 2,561,232 | 7/1951 | Rudel et al. | 260/485 |
| 2,562,144 | 7/1951 | Harman et al. | 252/48.6 |
| 2,575,195 | 11/1951 | Smith | 260/485 |
| 2,575,196 | 11/1951 | Smith | 260/485 |
| 2,603,616 | 7/1952 | Newton | 560/154 |
| 2,610,202 | 9/1952 | Kosmin et al. | 260/481 |
| 2,929,786 | 3/1960 | Young et al. | 252/56 |
| 2,993,773 | 7/1961 | Stromberg | 52/0.05 |
| 3,045,042 | 7/1962 | Staker | 260/485 |
| 3,112,268 | 11/1963 | Calhoun | 560/154 |
| 3,117,091 | 1/1964 | Staker | 252/56 |
| 3,198,737 | 8/1965 | Calhoun | 252/48.6 |
| 3,381,022 | 4/1968 | Le Suer | 260/404.8 |
| 3,459,787 | 8/1969 | Weesner | 560/154 |
| 4,198,305 | 4/1980 | Okorodudu | 252/48.6 |
| 4,615,818 | 10/1986 | DiBiase et al. | 252/48.6 |
| 4,702,850 | 10/1987 | Gutierrez et al. | 252/48.2 |

*Primary Examiner*—William R. Dixon, Jr.
*Assistant Examiner*—Rhonda Rochelle Brown
*Attorney, Agent, or Firm*—Joseph P. Fischer; Frederick D. Hunter; Robert A. Franks

[57] ABSTRACT

Lubricating oil compositions, particularly lubricating oil compositions comprising sulfur-containing polymeric polyesters. Sulfur-containing polyesters and methods for preparing same are also disclosed. The sulfur-containing polyesters are useful for preparing low-phosphorus containing lubricating oil compositions.

48 Claims, No Drawings

SULFUR-CONTAINING POLYMERIC POLYESTERS AND ADDITIVE CONCENTRATES AND LUBRICATING OILS CONTAINING SAME

FIELD OF THE INVENTION

This invention relates to lubricating compositions. More particularly, this invention relates to sulfur-containing polymeric polyesters, methods for preparing them, additive concentrates and lubricating compositions comprising sulfur-containing polymeric polyesters. In a general sense, the polyesters are derived from polybasic acids or anhydrides, particularly, succinic acids or anhydrides.

BACKGROUND OF THE INVENTION

Numerous esters and polyesters are known. Many are described as being useful as additives for lubricants and fuels. Illustrative examples of patents containing such disclosures include the following:

U.S. Pat. No. 2,540,570 teaches glycol or thioglycol esters of fatty acids, rosin acids, tall oil acids, etc. which are sulfurized or phosphorized. They are said to perform as extreme pressure additives in lubricants.

Esters of di- and tribasic carboxylic acids, having alkenyl substituents are prepared by esterifying the corresponding acid with primary monohydric alcohols or with monohydric alcohols containing oxygen or sulfur in ether or thioether linkages. These monomeric compounds are also taught as being suitable for use as lubricating oils.

U.S. Pat. No. 2,575,195 describes complex esters prepared by reacting one mole of a dibasic acid with one mole of a glycol in such a manner that a half ester is formed, after which the terminal hydroxyl and carboxyl groups are esterified with a monobasic acid and monohydric alcohol, respectively.

U.S. Pat. No. 2,575,196 teaches complex esters prepared by reacting one molecular proportion of a monobasic aliphatic acid with one molecular proportion of a glycol, forming a half ester of the glycol, after which two molecular proportions of such half ester are reacted with one molecular proportion of a dibasic aliphatic acid. The products of these patents are taught as being useful as synthetic lubricants and for use with mineral lubricating oils to give lubricants of improved viscosity index and pour point.

In U.S. Pat. No. 2,610,202 a compound made by reacting maleic anhydride with beta-mercaptoethanol is further reacted with a normal primary alcohol.

U.S. Pat. No. 2,929,786 teaches polyesters prepared from dibasic acids, or their esters, and glycols, including glycols containing thioether linkages. These compositions are said to be useful as additives or blending components in synthetic lubricant compositions.

A wide variety of esters of alkenyl succinic acids and anhydrides thereof are described as deposit modifiers for substantially hydrocarbon fuels. The esters are of mono-, di- and polyfunctional alcohols including mercaptoalkanols. U.S. Pat. Nos. 3,045,042 and 3,117,091 teach monomeric partial esters prepared by the reaction of alkyl or alkenyl succinic anhydrides with diols, triols or other polyhydric compounds including thiodiethanol.

Ester derivatives of hydrocarbon-substituted succinic acids containing at least about 50 aliphatic carbon atoms in the hydrocarbon substituent, which esters are prepared from monohydric and polyhydric alcohols, phenols and naphthols, are useful as additives in lubricating compositions, fuels, hydrocarbon oils and power transmitting fluids as well as being plasticizers, detergents, anti-rust agents and emulsifiers. Such materials are described in U.S. Pat. No. 3,522,179.

Functional fluid compositions containing ester additives derived from hydrocarbon substituted (which substituents include substituted hydrocarbon, preferably sulfur-substituted hydrocarbon) succinic acid and thio-bisalkanols are described in U.S. Pat. No. 4,702,850.

Each of the above-referenced patents is hereby expressly incorporated herein by reference for relevant disclosures contained therein.

SUMMARY OF THE INVENTION

This invention relates to a process for preparing a sulfur-containing polymeric polyester which comprises reacting at least one acid-ester of an alpha-beta unsaturated polybasic acid or functional derivative thereof, wherein said acid-ester contains an average of from about 1 to about 1.3 carboxylic acid groups, with a mixture of a source of sulfur and a mercaptoalkanol of the formula $$HS—(RO)_nH \qquad (I)$$

wherein R is an alkylene group, and n is a number ranging from 1 to about 20.

In a further embodiment, a composition of matter is described comprising a sulfur-containing polymeric polyester comprising at least 2 repeating units of the formula

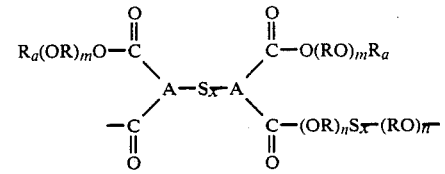

(II)

wherein each A is independently an alkylene group containing from 2 to about 24 carbon atoms, each $R_a$ is independently H or an alkyl or aryl group, each R is independently an alkylene group, each x is independently a number from 1 to about 6, each m is independently 0 or a number from 1 to about 20, and each n is a number ranging from 1 to about 20.

In another embodiment, this invention relates to a process for preparing a sulfur-containing polymeric polyester which comprises reacting a sulfur-coupled acid-ester of a polycarboxylic acid, $$(R_cOOC)_dR_3—S_x—R_3(COOR_c)_d \qquad (X)$$

wherein $R_3$ is a hydrocarbyl group, each $R_c$ is independently H, $R_a(OR)_m$, wherein R, $R_a$ and m are as defined hereinabove, or hydrocarbyl, with the proviso that at least one $R_c$ in each $(COOR_c)_d$ group is H, and d is at least 2, and wherein each $(COOR_c)_d$ group contains an average of from 1 to about 1.3 carboxylic acid groups, that is, groups where $R_c$ is H, x is a number from 1 to about 6, with at least one member of the group of thiodialkanols of the formula $$H(ORS_xR)_nOH, \qquad (IV)$$

the formula $$H(OR)_n—S_x—(RO)H \quad (V)$$

and the formula $$HO(RS)_nROH \quad (XI),$$

wherein x is a number from 1 to about 6, each R is independently an alkylene group and each n is independently a number from 1 to about 20.

In further embodiments, polymeric compositions prepared by the processes of this invention and lubricating oil compositions comprising these polymeric compositions are described.

In still another embodiment, this invention relates to lubricating oil compositions comprising a major amount of an oil of lubricating viscosity and a minor amount of a polymeric sulfur-containing polysuccinate ester having at least 2 repeating units of formula

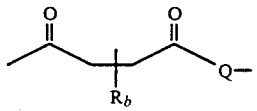

(VI)

wherein each Q is independently $$(OR)_nS_y(RO)_n \quad (VIII)$$

or $$(ORS_yR)_nO \quad (VIII),$$

each $R_b$ is independently hydrocarbyl or hydrocarbylthio, each R is independently an alkylene group, each y is independently 0 or a number ranging from about 1 to about 6, and n is a number ranging from 1 to about 20, with the proviso that at least one $R_b$ is hydrocarbylthio.

Thus, it is an object of this invention to provide sulfur-containing polyesters.

Another object is to provide lubricating oil and functional fluid compositions containing sulfur-containing polyesters.

A further object is to provide effective lubricating oil compositions containing reduced levels, often less than 0.08%, frequently less than 0.05%, by weight of phosphorus.

An additional object is to provide effective lubricating oil compositions that are essentially free of phosphorus.

These and other objects, advantages and features of the present invention will become apparent to those persons skilled in the art upon reading the details as more fully set forth below.

DETAILED DESCRIPTION OF THE INVENTION

Before the present sulfur-containing polyesters and processes for making such are described, it is to be understood that this invention is not limited to the particular polymeric polyesters or processes described as such compounds and methods may, of course, vary. It is also to be understood that the terminology used herein is for the purpose of describing particular embodiments only, and is not intended to be limiting since the scope of the present invention will be limited only by the appended claims.

It must be noted that as used in this specification and the appended claims, the singular forms "a", "an" and "the" include the plural unless the context clearly dictates otherwise. Thus, for example, reference to "a mercaptoalkanol" includes mixtures of mercaptoalkanols, reference to "an acid-ester" includes mixtures of such acid-esters, reference to "a polysuccinate ester" includes mixtures of polysuccinate esters and so forth.

Several terms are used herein, which terms are defined hereinbelow. The term "hydrocarbyl" is used herein to include substantially hydrocarbyl groups (for example, substantially hydrocarbyloxy, etc., as well as purely hydrocarbyl groups. Such groups may also be described as "hydrocarbon" groups, and the words may be used interchangeably unless the context clearly dictates otherwise. The description of groups as being substantially hydrocarbyl means they contain no nonhydrocarbyl substituents or non-carbon atoms which significantly affect the hydrocarbyl characteristics or properties of such groups relevant to their uses as described herein. Substituents which do not significantly alter the hydrocarbyl characteristics or properties of the hydrocarbyl group containing components of this invention will readily occur to those skilled in the art.

The term "hydrocarbyl" is not intended to infer any particular structure or valence. Thus, for example, a "hydrocarbyl" group may be alkyl, alkylene, aryl, aralkyl, arylene, alkaryl, etc. The nature of particular hydrocarbyl group referred to herein will be apparent to one of ordinary skill in the art.

Examples of hydrocarbyl groups or substituents which might be useful in connection with the present invention include the following:

(1) hydrocarbon groups or substituents, that is aliphatic (e.g., alkyl or alkenyl), alicyclic (e.g., cycloalkyl, cycloalkenyl) substituents, aromatic, aliphatic and alicyclic-substituted aromatic nuclei and the like as well as cyclic substituents wherein the ring is completed through another portion of the molecule (that is, for example, any two indicated substituents may together form an alicyclic radical);

(2) substituted hydrocarbon groups or substituents, that is, those containing nonhydrocarbon substituents which, in the context of this invention, do not alter the predominantly hydrocarbon character of the substituted group or substituent and which do not interfere with the reaction of a component or do not adversely affect the performance of a material when it is used in an application within the context of this invention; those skilled in the art will be aware of such radicals (e.g., alkoxy, carbalkoxy, alkylthio, sulfoxy, etc.);

(3) hetero groups or substituents, that is, groups or substituents which will, while having predominantly hydrocarbyl character within the context of this invention, contain atoms other than carbon present in a ring or chain otherwise composed of carbon atoms. Suitable heteroatoms will be apparent to those of ordinary skill in the art and include, for example, sulfur, oxygen, and nitrogen. Moieties such as, e.g., pyridyl, furyl, thienyl, imidazolyl, etc., are exemplary of hetero groups or substituents. No more than two heteroatoms, and preferably no more than one, will be present for each ten carbon atoms in the hydrocarbon-based groups or substituents.

Typically, unless otherwise specified, the hydrocarbon-based groups or substituents of this invention are essentially free of atoms other than carbon and hydrogen and are, therefore, purely hydrocarbyl.

Throughout the specification and claims of this invention, polyesters are described as polymeric polyesters. The expression "polyester" is often used in the art to refer to materials containing a plurality of ester groups. Thus, using such a definition, polyol esters derived from a polyol and a monobasic acid, for example, a triglyceride, or polycarboxylic acid esters derived from a polycarboxylic acid and a monohydric alcohol, for example, butyl succinate, could be considered polyesters. While the polymeric polyesters of this invention may comprise one or more such moieties, materials which comprise such moieties, but which are not polymeric polyesters, as defined herein are not part of this invention. Polymeric polyesters contain ester groups in repeating units described hereinabove, and hereinafter and in the claims.

As mentioned hereinabove, one embodiment of this invention relates to a process for preparing a sulfur-containing polymeric polyester which process comprises reacting, in the presence of a catalyst, at least one acid-ester of an alpha-beta unsaturated polybasic acid or functional derivative thereof, wherein said acid-ester is described in detail hereinbelow, with a mixture of a source of sulfur and a mercaptoalkanol of the formula $$HS—(RO)_nH \quad (I)$$

wherein the elements of mercaptoalkanol (I) are described in detail hereinbelow.

The Acid-Ester

The acid-ester has the general formula $$R_0(COOR_c)_d \quad (IX)$$

wherein $R_0$ is a hydrocarbon group characterized by the presence therein of an ethylenic linkage in an alpha-beta position with respect to at least one $(COOR_c)$ group. The $R_0$ group may contain from 2 to about 20 carbon atoms, preferably 2 to about 8 carbon atoms, more preferably from 2 to about 4 carbon atoms. The $R_0$ group may be substituted by a hydrocarbon group of from 1 to about 24 carbon atoms; however, most often R does not contain such substituents. Each $R_c$ is independently hydrogen, $R_a(OR)_m$, wherein $R_a$, R and m are as defined hereinabove, or hydrocarbyl, preferably alkyl, having from 3 to about 30 carbon atoms, often from about 4 to about 24 carbons, with the proviso that at least one $R_c$ is hydrogen, and the $(COOR_c)_d$ group contains an average of from 1 to about 1.3 carboxylic acid groups (groups of the formula COOH). The subscript d is a number ranging from two to about 8, preferably 2 to about 3. Preferred acid-esters are maleate or fumarate monoesters.

Methods for preparing acid-esters useful in the process of this invention are well known in the art. One particularly useful method is to react about one mole of an acidic reactant, for example, an anhydride such as maleic anhydride, with about one mole of an alcohol, often in the presence of a catalyst, for example, sodium acetate. Other useful acidic reactants include, but are not limited to, maleic acid, fumaric acid, itaconic acid, itaconic anhydride, citraconic acid, citraconic anhydride, mesaconic acid, glutaconic acid, aconitic acid, and the like. For reasons of cost, availability and the like, the acid-esters are often derived from an alpha-beta unsaturated dibasic acid or functional derivative thereof, such as maleic acid or anhydride. Useful alcohols for preparing the acid esters, for the sake of cost, availability and ease of use are primary monohydric alcohols. Exemplary alcohols include lower alcohols such as methyl, butyl, hexyl, etc., alcohols, fatty alcohols such as caprylic, oleic, etc., and commercially available mixtures, for example, mixtures sold under the name Neodol (Shell).

The acid-ester may be pre-formed or may be formed in situ. A pre-formed acid-ester reactant may be one which has been manufactured separately. Also included as a pre-formed acid-ester is one which is prepared just prior to use. In the latter case, the reaction vessel used for the process of this invention may also be used for preparing the acid-ester. Following preparation of the acid-ester reactant, the remaining reactants may be added as described hereinafter. Often, it is not necessary to purify the acid-ester before proceeding with the subsequent reaction.

When the acid-ester is formed in situ, at least some of the reactants to be used in the reaction to form products of this invention may be present in the reaction mixture.

It is preferred to employ a pre-formed acid-ester. For reasons of economics and processing flexibility, preparation of the acid-ester just prior to use, as described above, is particularly preferred.

Functional derivatives which react in a manner such that polyesters of the same type as are prepared from the acid-ester described hereinabove are also useful. Such functional derivatives may include esters of lower alcohols, amides, acyl halides and the like.

The Source of Sulfur

The source of sulfur useful in the process of this invention usually is elemental sulfur, which may be present as any of the allotropic solid forms or as molten sulfur. Other useful sources of sulfur include a mixture of sulfur dioxide and hydrogen sulfide which react yielding elemental sulfur and water, organic polysulfides, hydrogen polysulfide and the like. Other sources of sulfur will occur to those skilled in the art. For reasons of cost, availability and ease of use, elemental sulfur is preferred.

The amount of the source of sulfur which will be employed in the process is that amount which will yield a sulfur-containing polyester containing the desired amount of sulfur. Amounts in excess of that needed to attain the desired sulfur content in the sulfur-containing polyester often result in products having undesirable properties such as precipitation of sulfur, excessive sulfur activity, or are simply wasteful of raw materials.

The source of sulfur is generally used in amounts adequate to provide from about 0.1 to about 4 moles of sulfur per mole of the acid-ester. Preferably, from about 0.5 to about 3 moles, more preferably from about 0.5 to about 1 mole of sulfur per mole of acid-ester, is provided by the source of sulfur. As mentioned hereinabove, the source of sulfur is preferably elemental sulfur.

The Catalyst

Catalysts are often useful in the process of this invention. Optional catalysts include esterification catalysts. A sulfurization catalyst appears to facilitate the sulfurization reaction. The amount of sulfurization catalyst, when used, varies, depending on the nature of the catalyst. Usually at least about 0.01% by weight of catalyst is used, often from about 0.01 to about 5%, frequently from about 0.1 to about 2% or 0.1 to about 1% by weight.

A preferred sulfurization catalyst is magnesium oxide. The use of magnesium oxide as a catalyst for the sulfurization of alkyl mercaptans is described in European Patent Application No. 0108149. Other catalysts taught by this European Patent Application to be useful are the remaining alkaline earth metal oxides such as calcium oxide and barium oxide. It is taught that in order for the alkaline earth metal oxides to be effective catalysts, they must be used in combination with alcohols, for example, isopropyl alcohol and butyl alcohol. Numerous other sulfurization catalysts are known, and are described in the literature. Many useful catalysts are described in Davis, U.S. Pat. No. 4,119,549 which, along with European Patent Application No. 0108149, is expressly incorporated by reference for relevant disclosures contained therein.

Various metal-containing compounds serve as catalysts for esterification of a carboxylic acid moiety with an OH-containing reagent. Particularly useful catalysts are titanium alkoxides, tin carboxylates, aluminum alkoxides, and certain metal-containing oxides including $Sb_2O_3$, $SnO_2$ and $PbO_3$. Catalysts such as sulfuric acid, pyridine hydrochloride, hydrochloric acid, benzene sulfonic acid, p-toluene sulfonic acid, phosphoric acid, or any other known esterification catalyst may be used. Other materials useful as catalysts will occur to the skilled worker. The amount of the catalyst in the esterification reaction may be as little as 0.01% by weight of the reaction mixture, more often from about 0.1% to about 5%.

The Mercaptoalkanol

The process for preparing a sulfur-containing polyester comprises reacting the acid-ester recited hereinabove with a source of sulfur and with a mercaptoalkanol of the formula $$HS-(RO)_nH \quad (I)$$

wherein R is an alkylene group and n is a number ranging from 1 to about 20. The alkylene group usually contains from 2 to about 24 carbon atoms, more often from 2 to about 8 carbon atoms. Most often, R will contain 2 or 3 carbon atoms. The number n preferably ranges from 1 to about 10, often from 1 to about 6. Very often, n equals 1.

Mercaptoalkanols are readily prepared by methods known in the art. A preferred method is to react hydrogen sulfide with an epoxide, such as ethylene oxide. Other useful epoxides include alpha-olefin epoxides such as 1,2-epoxy hexadecane and epoxides having the epoxy group at an internal position, such as 9–10 epoxy butyl stearate. Other epoxides useful for preparing mercaptoalkanols for use in the process of this invention will occur to those skilled in the art.

The various reactants can be present in the process of this reaction in amounts covering a broad range.

The amount of mercaptoalkanol of formula (I) used in the process of this invention usually ranges from about 0.5 to about 2 moles, per mole of acid-ester. Preferably from about 0.9 to about 1.5 moles, more preferably from about 1 to about 1.2 moles of mercaptoalkanol per mole of acid-ester, are used in the process of this invention.

As mentioned hereinabove, the amount of catalyst, if employed in the process, depends on the particular nature of the catalyst and other reaction conditions, for example, reaction temperature, nature of the various reactants and the like.

The reactants preferably are employed within the above-stated ranges. Generally, it is most desirable to employ the reactants in amounts near the stoichiometric amounts needed to prepare desired products. It is sometimes helpful to use a moderate excess, for example, about 5–10% excess, of one or more reactant. While it is often possible to use a large excess of any of the various reactants, the presence of excess reactant in the reaction mixture or in the sulfur-containing polymeric polyester usually does not provide any added benefit, and is thus wasteful of raw materials. Also, when a large excess of one or more reactants is employed, added cost is involved if it is desired to remove any appreciable amount of unreacted material.

The sulfurization reaction may be conducted at temperatures ranging from about 40° C. to about 210° C., preferably from about 80° C. to about 190° C. The reaction is most often conducted at atmospheric pressure, but may be conducted under superatmospheric pressure, particularly when one or more of the reactants is appreciably volatile at the reaction temperature. Generally, there is no advantage to conducting the reaction under reduced pressure, except it is sometimes advantageous to remove moderately volatile by-products under slightly reduced pressure during the course of the reaction.

The polymeric polyester may be recovered without additional purification, that is, unreacted materials and certain by-products may remain in the product. Generally, by-products such as water of reaction, etc., are removed during the course of the reaction, since the presence of such by-products sometimes slows the progress of the reaction. Volatile by-products are generally removed during the course of reaction or thereafter by stripping, often under reduced pressure, at elevated temperatures above the boiling point of the by-product, by nitrogen blowing, and the like. Preferably, the polyester is purified by stripping of remaining volatile by-products and unreacted materials, filtration and the like after the reaction has been completed. The sulfur-containing polyester usually has a molecular weight ranging from about 1000 to about 10000, more often from about 1000 to about 5000.

This invention also relates to sulfur-containing polymeric polyesters comprising at least 2 repeating units of the formula

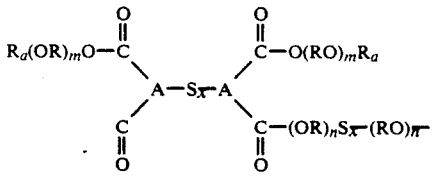

(II)

Often the polymeric polyester comprises from 2 to about 8 repeating units, frequently from about 3 to about 5 repeating units. In formula II, each A is independently an alkylene group containing from 2 to about 24 carbon atoms, more often from 2 to about 4 carbon atoms. The A group may contain substituents such as ester groups, carboxylic acid groups, amide groups, and the like. Preferably, except for the substituents shown in formula (II), A is free of substituents. The carbonyl group containing substituents shown in (II) are generally not on the same carbon atom of A. Each $R_a$ is independently H or an alkyl or aryl group, preferably an alkyl group containing from 3 to about 30 carbon atoms, and more preferably an alkyl group containing from 8 to about 24 carbon atoms. Each R is independently an alkylene group, often containing from 2 to about 24 carbon atoms. Preferably, each R independently contains from 2 to about 4 carbon atoms. Each x is independently a number from 1 to about 6, and preferably, a number from 1 to about 3. Each m is independently 0 or a number from 1 to about 20, preferably 0, and each n is independently a number ranging from 1 to about 20, preferably from 1 to about 2.

The polymeric polyester comprising units of formula (II) may terminate by linking with itself, forming a ring, or each terminal group may independently comprise a group of formula (III)

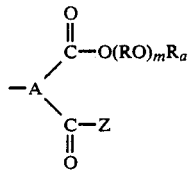

(III)

wherein A is as defined hereinabove, each Z is independently a member of the group consisting of OH, $—NR_1R_2$, $—(OR)_nS_y(RO)_nH$, or $—O(R—O)_mR_a$. $R_1$ and $R_2$ are each independently H or lower alkyl groups (that is, alkyl groups containing up to about 7 carbon atoms), each m is independently zero or a number from 1 to about 20, preferably zero or a number from 1 to about 2, each n is independently a number from 1 to about 20, preferably from 1 to about 2, each y is zero or a number from 1 to about 6, preferably zero or a number from 1 to about 3, and R and $R_a$ are as defined hereinabove, except that when y=0, R is often a methylene or substituted methylene group; or, when Z is OH, that is when the terminal group contains a carboxylic acid group, a salt may be formed by reaction with a basic, metal-containing reagent, ammonia or an amine. Preferred metals are sodium, magnesium, potassium, calcium, zinc or copper. Examples of amines are methylamine, butylamine, oleylamine, dibutylamine, ethylene diamine and the like.

The polymeric polyester comprising units of formula II frequently has a molecular weight ranging from about 1000 to about 10000, more often from about 1000 to about 5000. As is readily apparent, the number of repeating units and the number of carbon atoms and the nature of substituent groups, if any, and terminal groups will influence the molecular weight.

In yet another embodiment, a process is described for preparing a sulfur-containing polymeric polyester which comprises reacting sulfur-coupled acid-esters of polycarboxylic acids with at least one member of a group of thiodialkanols.

The Sulfur-Coupled Acid-Esters

The sulfur-coupled acid-esters of polycarboxylic acids useful in this process have the general formula $$(R_cOOC)_dR_3—S_x—R_3(COOR_c)_d \quad (X)$$

wherein $R_3$ is a hydrocarbon group, usually an aliphatic hydrocarbon group. The $R_3$ group often contains from 2 to about 20 carbon atoms, preferably 2 to about 8 carbon atoms, more preferably from 2 to about 4 carbon atoms. The $R_3$ group may be substituted by a hydrocarbon group having from 1 to about 24 carbon atoms. The $R_c$ group is hydrogen, $R_a(OR)_m$, wherein R, $R_a$ and m are as defined hereinabove, or hydrocarbyl, preferably alkyl, having from about 3 to about 30 carbon atoms, often from about 4 to about 24 carbon atoms, with the proviso that at least on $R_c$ in each $(COOR_c)_d$ group is H, wherein each $(COOR_c)_d$ group contains an average of from 1 to about 1.3 carboxylic acid groups. The subscript d is independently a number ranging from 2 to about 8, preferably 2 to about 3. Each x is independently a number from 1 to about 6, preferably from 1 to about 3. In an especially preferred embodiment, the sulfur coupled acid-ester comprises sulfur coupled monoalkyl esters of dibasic acids, especially those wherein the dibasic acid is a succinic acid. Preferably, each ester moiety of the sulfur coupled polycarboxylic acid contains, including the carbonyl carbon, from about 4 to about 31 carbon atoms, preferably from about 9 to about 25 carbon atoms, and more preferably up to about 18 carbon atoms.

Many sulfur-coupled acid esters are known and can be prepared by methods known to those skilled in the art. For example, thio-bis-half esters of succinic acids can be prepared by reacting hydrogen sulfide in the presence of a basic catalyst with an acid-ester of maleic acid. Such a process is described in U.S. 3,299,121, which is expressly incorporated herein by reference for relevant disclosures therein. The sulfur-coupled acid-ester may also be formed in situ in a fashion analogous to that described hereinabove for the acid-ester reactant.

The Thiodialkanols

Thiodialkanols useful in the process of this invention are those having the formula $$H(ORS_xR)_nOH, \quad (IV)$$

the formula $$H(OR)_n—S_x—(RO)_nH \quad (V)$$

and the formula $$HO(RS_x)_nROH \quad (XI)$$

and oligomers thereof, wherein x is a number from 1 to about 6, preferably from 1 to about 3, often 1, each R is independently an alkylene group, which often contains from 2 to about 24 carbon atoms and preferably contains from 2 to about 4 carbon atoms, each n is independently a number from 1 to about 20, preferably 1 to 5, more preferably from 1 to about 2. It is, of course, recognized that when n=1, and all of the other elements are the same the compounds represented by formulae (IV), (V) and (XI) are the same.

The above-described thiodialkanols are known and may be prepared by methods known to those skilled in the art. For example, thiodialkanols of formula (V) can be prepared by condensing one mole of $H_2S$ with two or more moles of an epoxide. Mercaptoalkanols may be reacted with sulfur or with various oxidizing agents to yield compounds of formula (V). Specific details are familiar to those of skill in the chemical arts. Useful epoxides include those mentioned hereinabove in the description of mercaptoalkanols and their preparation.

Certain thiodialkanols of formula (IV), also referred to in the art as thiodialkanol polyethers, can be prepared by the condensation of thiodialkanols of formula (V) wherein n in formula (V) is 1. These materials are also available commercially from, for example, Pennwalt or Morton-Thiokol, Inc. Thiodiakanols of formulae (XI) can be prepared by condensation of mercaptoalkanols with thiodalkanols.

Esterification catalysts, of the type, and in the amounts, disclosed hereinabove may be used in the process of reacting thiodialkanols with sulfur-coupled acid esters. The reaction is usually conducted under such conditions that water formed during the esterification is removed continuously. A convenient method is to conduct the reaction in a solvent, at reflux, and removing water as an azeotrope. It is especially desirable to add the mercaptoalkanol to a refluxing mixture of acid and catalyst.

This invention also contemplates compositions prepared by the processes of this invention, additive concentrates comprising a substantially inert, normally liquid diluent and about 1-90% by weight of the compositions of this invention, and lubricating compositions comprising a major amount of an oil of lubricating viscosity, and a minor, property improving amount of the compositions or additive concentrates of this invention.

Also contemplated are lubricating oil compositions comprising a major amount of an oil of lubricating viscosity and minor amounts of polymeric polysuccinate esters having at least 2 repeating units, often 2 to about 8 repeating units, frequently from about 3 to about 5 repeating units of the formula

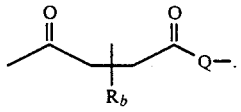

(VI)

Each Q is independently $$(OR)_nS_y(RO)_n \quad \text{(VII)}$$

or $$(ORS_yR)_nO \quad \text{(VIII)}.$$

Each R in the above formulas is independently an alkylene group, preferably an alkylene group containing from 2 to about 24 carbon atoms, more preferably from 2 to about 4 carbon atoms, and more often from 2 to 3 carbon atoms. Each y is independently 0 or a number ranging from 1 to about 6, more often a number ranging from 1 to about 3. When y=0, each R is often a methylene or a substituted methylene group. Each n is a number ranging from 1 to about 20, more often a number ranging from 1 to about 5, and preferably a number from 1 to about 2. Each $R_b$ is independently hydrocarbyl or hydrocarbylthio, preferably alkyl or alkylthio, with the proviso that at least one $R_b$ is hydrocarbylthio. Preferably each $R_b$ contains from 8 to about 30 carbon atoms, more preferably from 8 to about 18 carbon atoms. Most preferably, each $R_b$ is an alkylthio group having from about 8 to about 30 carbon atoms, more often from about 8 to about 24 carbon atoms, and usually from about 8 to about 18 carbon atoms. The polysuccinate ester of formula (VI) usually has a molecular weight ranging from about 1,000 to about 10,000, more often from about 1,000 to about 5,000.

Polymeric polysuccinate polyesters of formula (VI) can be prepared by methods known in the art. For example, an alkylthio-substituted succinic acid can be reacted with an alpha-omega diol, a thiodialkanol and the like. Methods for preparing various sulfur-containing polyesters falling within the scope of formula VI are described in Stromberg (U.S. Pat. No. 2,993,773) which is hereby expressly incorporated by reference for relevant disclosures contained therein. Other methods will occur to those of ordinary skill in the art.

Methods for determining molecular weights of polymers are well known in the art. Such methods include gel permeation chromatography, boiling point elevation, vapor phase osmometry and others. Textbooks on general polymer chemistry, including "Macromolecules, An Introduction to Polymer Science", F. A. Bovey and F. H. Winslow, Editors, Academic Press, New York (1979), pages 296-316, and P. J. Flory, "Principles of Polymer Chemistry", Cornell University Press (1953) Chapter VII, pages 266-316, describe these methods. It has been found that vapor phase osmometry (VPO) is a particularly useful method for determining number average molecular weights of the polysuccinate esters of this invention.

Gel permeation chromatography is an effective tool for measuring molecular weights, particularly when the instrument is calibrated against known compounds of similar structure and molecular weight.

The following examples are provided to illustrate the processes and compositions of the present invention. These examples are provided to teach those of ordinary skill in the art how to make and use the compositions of this invention. These illustrations are not to be interpreted as specific limitations as to the scope of what the inventors regard as their invention. Efforts have been made to insure accuracy with respect to numbers used (e.g., amounts, temperature, etc.). Unless indicated otherwise, parts are parts by weight, temperature is in degrees Celsius and pressure is at or near atmospheric.

EXAMPLE 1

A five-liter flask equipped with a nitrogen inlet, a thermowell, a stirrer and a Dean-Stark trap is charged with 490 parts maleic anhydride, 1,080 parts of a mixture of linear primary alcohols containing from about 12 to about 18 carbon atoms (Alfol 12-18-Conoco), 1,000 parts toluene and 2.5 parts anhydrous sodium acetate. The mixture is heated with stirring to 100° C. and held for 2 hours at 100° C. Infrared analysis indicates only a trace of anhydride remaining. The materials are cooled to 45° C. followed by addition of 160 parts sulfur and 7 parts magnesium oxide. Mercaptoethanol, 390 parts, is added dropwise at 45° C. over 0.25 hours. No exothermic reaction is noted. The materials are stirred 1 hour at 60° C., 1 hour at 80° C. and 1 hour at 100° C. The materials are then heated to reflux (140° C.) and held at 140° C. for 6 hours. Solvent is removed by distillation and reflux temperature increases to 180° C. The reaction is held at 180° C. for 5 hours while 79 parts water is collected in the Dean-Stark trap. The reaction is stripped to 160° C. at 20 Torr. The residue is filtered at 100° C. through a diatomaceous earth filter aid. An oil-soluble product is obtained containing 15.5% sulfur and having a number average molecular weight, determined by vapor phase osmometry, of 1,796.

EXAMPLE 2

Following essentially the same procedure described in Example 1, a toluene solution (1,000 parts toluene) of 490 parts maleic anhydride, 1,080 parts Alfol 12–18 alcohol and 2.5 parts sodium acetate are reacted for 2 hours at 100° C. The reaction mixture is cooled to 45° C. and 7 parts magnesium oxide and 80 parts sulfur are added. 390 parts mercaptoethanol is added dropwise at 45° C. at 0.5 hours. Heating is then conducted in the same fashion as described for Example 1. The reaction mixture is stripped to 160° C. at 20 Torr, the residue is filtered through diatomaceous earth filter aid yielding a product containing 11.8% sulfur and having a number average molecular weight, determined by vapor phase osmometry, of 1,650.

EXAMPLE 3

The procedure of Example 1 is repeated except maleic anhydride is replaced with an equivalent amount of itaconic anhydride.

EXAMPLE 4

The procedure of Example 1 is repeated replacing the Alfol 12–18 alcohol with an equivalent amount (based on OH) of isooctyl alcohol.

EXAMPLE 5

The procedure of Example 1 is followed except a 10% molar excess of mercaptoethanol is employed.

The following examples (Examples 6–8) illustrate means for introducing various terminal functionality into the polyesters of this invention. In these examples, the polyester of Example 1 is post-treated with various reagents in the amounts indicated.

| Example | Reagent | Amount | Functionality |
|---|---|---|---|
| 6 | Octyl alcohol | 1 mole: equivalent acid | Ester |
| 7 | NaOH | 1 equivalent: 1 equivalent acid | Salt |
| 8 | Dibutylamine | 1 mole: mole acid | Salt |

EXAMPLE 9

A sulfur-containing polyester is prepared by reacting 770 parts 2,2'-thio bis(oleyl hydrogen succinate) with 162 parts of 95% purity 2-hydroxyethyl disulfide.

EXAMPLE 10

Following the procedure of Example 9, 350 parts 2,2'-thio bis(ethyl hydrogen succinate) are reacted with 162 parts of 95% 2-hydroxyethyl disulfide.

EXAMPLE 11

Example 9 is repeated replacing 2-hydroxyethyl disulfide with 122 parts 2-hydroxyethyl sulfide.

EXAMPLE 12

Example 9 is repeated replacing 2-hydroxyethyl disulfide with 434 parts of a thiodiglycol polyether having the average composition $H(OCH_2CH_2SCH_2CH_2)40H$.

EXAMPLE 13

A polymeric polysuccinate ester is prepared by reacting 1 mole of 2-octadecyl-thio succinic anhydride with 1 mole of 2-hydroxyethyl disulfide.

EXAMPLE 14

Example 13 is repeated replacing 2-hydroxyethyl disulfide with 1 mole 2-hydroxyethyl sulfide

EXAMPLE 15

Example 13 is repeated replacing 2-hydroxyethyl disulfide with 522 parts of the thiodiglycol polyether described in Example 12.

Lubricating compositions of this invention may be prepared by adding the sulfur-containing polyesters directly into the base oil. More often, the compositions of this invention are present as components of an additive concentrate which may contain other additives and which often contains an inert organic diluent. Such additive concentrates usually comprise from about 1 to about 90% by weight of the polyesters of this invention.

The polymeric sulfur-containing polyesters described herein are used in oils of lubricating viscosity at levels adequate to provide enhanced performance benefits to the lubricating composition. They are present in minor amounts in lubricating compositions comprising a major amount of an oil of lubricating viscosity. By minor amounts is meant less than 50% of the total, e.g., 1%, 5%, 49%, etc. Major amounts are greater than 50% of the total, e.g., 50.5%, 70%, 99%, etc. The polymeric polyesters of this invention are frequently used at levels ranging from about 0.05 to about 35 percent by weight of the lubricating composition. More often they constitute at least 0.1% up to about 20%, more often up to about 5% by weight. In phosphorus-free hydraulic fluids they are frequently used at from about 0.1–3% by weight of the total composition, often from about 0.25 to about 1% by weight, and more often from about 0.5 to about 0.75% by weight.

The lubricating compositions of this invention employ an oil of lubricating viscosity, including natural or synthetic lubricating oils or mixtures thereof.

Natural oils include animal oils and vegetable oils (e.g. castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins, etc. and mixtures thereof, alkylbenzenes, polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used.

Another suitable class of synthetic lubricating oils that can be used comprises the esters of dicarboxylic acids with a variety of mono- and polyhydric alcohols or polyol ethers, and those made from $C_5$ to $C_{12}$ monocarboxylic acids and polyols and polyol ethers.

Other synthetic lubricating oils include liquid esters of phosphorus-containing acids, polymeric tetrahydrofurans and the like, silicon-based oils such as the polyalkyl-, polyaryl-, polyalkoxy-, or polyaryloxysiloxane oils and silicate oils.

Unrefined, refined and rerefined oils, either natural or synthetic (as well as mixtures of two or more of any of these) of the type disclosed hereinabove can be used in the lubricating compositions of the present invention. Unrefined oils are those obtained directly from a natural or synthetic source without further purification treatment. Refined oils are similar to the unrefined oils except they have been treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Specific examples of the above-described oils of lubricating viscosity are given in Chamberlin III, U.S. 4,326,972 and European Patent Publication 107,282, both of which are hereby incorporated by reference for relevant disclosures contained therein.

A basic, brief description of lubricant base oils appears in an article by D. V. Brock, "Lubrication Engineering", Volume 43, pages 184–5, March, 1987, which article is expressly incorporated by reference for relevant disclosures contained therein.

Other Additives

As mentioned, the compositions, additive concentrates and lubricating compositions of this invention may contain other additives. The use of such additives is optional, and the presence thereof in the compositions, additive concentrates and lubricating compositions of this invention will depend on the particular use and level of performance required. One optional additive is a metal salt of a dithiophosphoric acid. Examples include copper, molybdenum, nickel and zinc salts of dithiophosphoric acids. Salts of dithiophosphoric acids are often referred to as metal dithiophosphates, metal O,O -dihydrocarbyl dithiophosphates, and by other commonly used names. The zinc salts are sometimes referred to by the abbreviation ZDP. One or more metal salts of dithiophosphoric acids may be present in a minor amount to provide additional extreme pressure, anti-wear and anti-oxidancy properties. Of course, in low-phosphorus containing compositions, the amount of salt of dithiophosphate will be limited and will not be present at all in phosphorus-free compositions.

In addition to metal salts of dithiophosphoric acids discussed hereinabove, other additives that may optionally be used in the compositions, additive concentrates and lubricating compositions of this invention include, for example, detergents, dispersants, viscosity improvers, oxidation inhibiting agents, pour point depressing agents, extreme pressure agents, anti-wear agents, color stabilizers, anti-foam agents, and anti-oxidants.

Auxiliary extreme pressure agents and corrosion and oxidation inhibiting agents are exemplified by chlorinated aliphatic hydrocarbons, organic sulfides and polysulfides, phosphorus esters including dihydrocarbon and trihydrocarbon phosphites, molybdenum compounds, and the like.

Viscosity improvers (also sometimes referred to as viscosity index improvers) are usually polymers, including polyisobutenes, polymethacrylic acid esters, diene polymers, polyalkyl styrenes, alkenylarene-conjugated diene copolymers and polyolefins. Multifunctional viscosity improvers which also have dispersant and/or anti-oxidancy properties are known and may optionally be used.

Pour point depressants are a particularly useful type of additive. See for example, page 8 of "Lubricant Additives" by C. V. Smalheer and R. Kennedy Smith (Lezius-Hiles Company Publishers, Cleveland, Ohio, 1967). Pour point depressants useful for the purpose of this invention, techniques for their preparation and their use are described in U.S. Pat. Nos. 2,387,501; 2,015,748; 2,655,479; 1,815,022; 2,191,498; 2,666,748; 2,721,877; 2,721,878; and 3,250,715 which are expressly incorporated by reference for their relevant disclosures.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

Detergents and dispersants may be of the ash-producing or ashless type. The ash-producing detergents are exemplified by oil soluble neutral and basic salts of alkali or alkaline earth metals with sulfonic acids, carboxylic acids, phenols or organic phosphorus acids characterized by at least one direct carbon-to-phosphorus linkage.

The term "basic salt" is used to designate metal salts wherein the metal is present in stoichiometrically larger amounts than the organic acid radical. Basic salts and techniques for preparing and using them are well known to those skilled in the art and need not be discussed in detail here.

Ashless detergents and dispersants are so-called despite the fact that, depending on its constitution, the detergent or dispersant may upon combustion yield a non-volatile residue such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent No. 1,306,529 and in many U.S. patents including the following:

| | | |
|---|---|---|
| 3,163,603 | 3,381,022 | 3,542,680 |
| 3,184,474 | 3,399,141 | 3,567,637 |
| 3,215,707 | 3,415,750 | 3,574,101 |
| 3,219,666 | 3,433,744 | 3,576,743 |
| 3,271,310 | 3,444,170 | 3,630,904 |
| 3,272,746 | 3,448,048 | 3,632,510 |
| 3,281,357 | 3,448,049 | 3,632,511 |
| 3,306,908 | 3,451,933 | 3,697,428 |
| 3,311,558 | 3,454,607 | 3,725,441 |
| 3,316,177 | 3,467,668 | 4,194,886 |
| 3,340,281 | 3,501,405 | 4,234,435 |
| 3,341,542 | 3,522,179 | 4,491,527 |
| 3,346,493 | 3,541,012 | RE 26,433 |
| 3,351,552 | 3,541,678 | |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl groups contains at least about 30 carbon atoms with aldehydes (especially formaldehyde) and amines (especially polyalkylene polyamines), which may be characterized as "Mannich dispersants". The materials described in the following U.S. patents are illustrative:

| | |
|---|---|
| 3,413,347 | 3,725,480 |
| 3,697,574 | 3,726,882 |
| 3,725,277 | |

(4) Products obtained by post-treating the carboxylic amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,522 |
| | | | 4,234,435 |

(5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

The above-illustrated additives may each be present in lubricating compositions at a concentration of as little as 0.001% by weight usually ranging from about 0.01% to about 20% by weight. In most instances, they each present at from about 0.1% to about 10% by weight.

The various additives and compositions described herein can be added directly to the lubricating oil. Preferably, however, they are diluted with a substantially inert, normally liquid organic diluent such as mineral oil, naphtha, benzene, toluene or xylene, to form an additive concentrate. These additive concentrates usually comprise about 1 to about 90% by weight of the compositions of this invention and may contain, in addition, one or more other additives known in the art or described hereinabove. Chemical concentrations such as 15%, 20%, 30% or 50% or higher may be employed.

The lubricating compositions of this invention find utility in many areas. Examples include, but are not limited to, lubricants for internal combustion engines, such as fuel economy improving oils, power transmission fluids such as automatic transmission fluids, hydraulic fluids, power shift oils and tractor oils. Tractor oils frequently serve multiple purposes such as hydraulic fluids, wet brake lubricants, engine lubricants, etc., all employing a lubricant from a common sump. Other areas of application include industrial applications such as metal-working fluids and industrial gear oils. The compositions of this invention also find utility in various aqueous systems such as are described by Forsberg in U.S.. Pat. Nos. 4,329,429, 4,368,133, 4,448,703, and in other aqueous compositions, as extreme pressure/antiwear additives.

The hereindescribed sulfur-containing polyesters enhance the performance of oils of lubricating viscosity. They provide extreme pressure and antiwear properties to gear lubricants, both automotive and industrial gear oils. They serve as non-phosphorus extreme pressure/antiwear additives for hydraulic fluids. In tractor lubricants they provide extreme pressure, antiwear, and, particularly when the polyester contains hydrocarbon groups containing from about 8 to about 24 carbon atoms, anti-chatter performance for wet brakes. The sulfur-containing polyesters also provide wear protection for engine oils, and are particularly beneficial for low-phosphorus containing engine oils. Low phosphorus engine oils are those containing less than about 0.08% by weight of phosphorus, preferably less than about 0.05% by weight of phosphorus. Particularly valuable are compositions that are essentially free of phosphorus. They are also useful in power transmitting fluids such as automatic transmission fluids and hydraulic fluids which require a balance of anti-oxidancy, antiwear, friction modification and other properties. It has been found that the polymeric polyesters of this invention can be used as additives for hydraulic fluids that are essentially free of phosphorus. Such fluids are especially desirable and valuable. The sulfur-containing polyesters of this invention also impart antioxidancy to organic systems, e.g., lubricants.

Typical additive concentrates and lubricating oil compositions of this invention are illustrated by the following Examples The lubricating compositions are prepared by combining the specified ingredients in the indicated amounts, individually or from concentrates, and oil of lubricating viscosity to make the total 100 parts by weight. The amounts shown are parts by weight and, unless indicated otherwise, are amounts of chemical present on an oil-free basis. Thus, for example, an additive comprising 50% oil used at 10% by weigh in a blend, provides 5% by weight of chemical. Any oil which may be present in a listed additive is considered, for the purposes of these Examples, to be part of the oil of lubricating viscosity. Unless otherwise indicated, listed amounts of purchased commercial additives are not adjusted for oil content. These examples are presented for illustrative purposes only, and are not intended to limit the scope of this invention.

Examples A–B

Engine Oils

Two lubricating compositions are prepared by blending into a mineral oil basestock (Exxon stocks), 0.52 parts of hydrogenated styrene-diene copolymer, 0.08 parts of amine neutralized styrene-alkyl maleate copolymer, 1.65 parts of polyisobutenyl substituted succinimide, 0.23 parts of zinc dialkyl dithiophosphate, 0.10 parts of fatty acid amide, 0.25 parts of calcium overbased sulfonate, 0.42 parts of a commercial magnesium sulfonate (Witco), 1.0 part of the product of Example 1, 50 parts per million (ppm) of a 10% solution in kerosene of silicone antifoam and additional amounts of other additives as indicated hereinbelow:

| Additional Ingredient | Example A | Example B |
|---|---|---|
| SAE Grade | 10W-30 | 10W-40 |
| Alkylated aryl amine | 0.25 | 0.34 |
| Sulfurized Diels-Alder adduct | 1.80 | 2.20 |
| Copper salt of organic acid | 0.05 | |
| Sodium overbased sulfonate | 0.21 | 0.30 |

Example C

Tractor Fluids

A composition intended for use as a multi-purpose lubricant, serving as an engine oil and gear lubricant, a hydraulic fluid and a wet-brake lubricant, all from a single sump on a tractor, which composition comprises a mineral oil basestock (Amoco 10W-30), 3.0 parts of a commercial methacrylate copolymer (Acryloid 953 - Rohm & Haas), 0.15 parts of a commercial pour point depressant (Hitec E-672 - Ethyl), about 0.02 parts of a mixture of hydrocarbon solutions of silicone antifoam agents, 1.1 parts of the reaction product of polyisobutenyl substituted succinic anhydride with pentaerythritol and a polyamine, 0.94 parts of a polyisobutenyl substituted succinimide, 1.86 parts of calcium overbased sulfurized alkyl phenol, 3.90 parts of a mixture of zinc salts of dialkyldithiophosphates, 1.62 parts of a mixture of basic magnesium sulfonates, including 0.50 parts of a commercial product sold as Hybase M400 (Witco) and 2.0 parts of the product of Example 1.

Example D–F

Hydraulic Fluid Compositions

| Component | Example D | Example E | Example F | Example G |
|---|---|---|---|---|
| Mineral oil (Sun 250 Neutral) | Balance | | | |
| Epoxide post-treated dialkyl dithiophosphate-alkyl acrylate reaction product | 0.60 | | | |
| Alkyl aromatic triazole | 0.005 | | 0.001 | 0.01 |
| Alkyl aromatic amine | 0.42 | 0.42 | | 0.25 |
| Partial hydroxy alkyl ester of alkyl substituted succinic acid | 0.03 | 0.03 | | 0.05 |
| Commercial polyoxyalkylene demulsifier (Petrolite) | 0.007 | 0.007 | 0.008 | |
| Product of Example 1 | 0.20 | 2.4 | 0.15 | 0.6 |
| Zinc salt of dialkyl dithiophosphate-carboxylic acid mixture | | | 0.47 | |
| Basic calcium sulfonate | | | 0.01 | |
| Alkyl phenol | | | 0.18 | 0.25 |
| Commercial basic calcium sulfurized phenate (Oloa 219 - Chevron) | | | 0.07 | |

Examples H–J

Gear Lubricants

Example H

A lubricating composition is prepared by blending into an SAE 80W-90 basestock (Exxon), 0.40 parts of an amine modified styrene-alkyl maleate copolymer and 2.0 parts of the product of Example 2.

Example I

A lubricating composition like that of Example G is prepared except it also contains 0.22 parts of a zinc salt of a dialkyldithiophosphate.

Example J

A lubricating composition is prepared by blending into an SAE 80W-90 basestock (Exxon), 0.40 parts of an amine modified styrene-alkyl maleate copolymer, 4.5 parts of the product of Example 1, 1.35 parts of an amine salt of a mixed mono- and di-alkyl phosphate, 0.35 parts of a fatty amine, 0.1 parts of a dimercaptothiadiazole based corrosion inhibitor (Amoco 153 Amoco) and 0.1% of a mixed ester antifoam agent.

Examples K–N

Automatic Transmission Fluids

Example K

A composition is prepared by blending into a mineral oil base (100 neutral oil - Cities) 0.025 parts of red dye, 0.042 parts of a kerosene solution of silicone antifoams, 1.16 parts of a carbon disulfide post-treated polyisobutene substituted succinimide, 0.67 parts of a borated polyisobutene substituted succinimide, 0.125 parts of ethoxylated fatty amine, 0.16 parts of a fatty hydroxylalkyl imidazoline, 0.53 parts of basic calcium sulfonate, 0.01 parts of alkyl aromatic triazole, 0.03 parts of a zinc salt of a dialkyl dithiophosphate, 0.10 parts of alkylated aryl amine, 0.593 parts of hydroxy thioether, 1.57 parts of amine modified styrene-alkyl maleate copolymer, and 0.50 parts of the product of Example 1.

Example L

A composition like that of Example J is prepared, except it also contains 0.11 parts of dibutyl phosphite.

Example M

A composition is prepared by blending into a mineral oil base (100 neutral - Cities), 0.025 parts of red dye, 1.79 parts of an amine-modified styrene-alkyl maleate copolymer, 0.028 parts of a kerosene solution of silicone antifoams, 1.75 parts of a polyisobutenyl substituted succinimide, 0.68 parts of a borated polyisobutenyl substituted succinimide, 0.31 parts of basic calcium sulfonate, 0.50 parts of a zinc salt of dialkyl dithiophosphates, 0.194 parts of the reaction product of tetrapropenyl substituted succinic anhydride with a commercially available polyoxyethylene glycol (Carbowax 300 - Union Carbide), 0.613 parts of a hydroxythioether, 0.09 parts of alkylated aryl amine and 0.70 parts of the product of Example 2.

Example N

A composition is prepared by blending with a mineral oil basestock (Exxon ATF base) 0.025 parts of red dye, 0.042 parts of a kerosene solution of silicone antifoams, 1.14 parts of a carbon disulfide, post-treated polyisobutene substituted succinimide, 0.66 parts of a borated polyisobutene substituted succinimide, 0.53 parts of basic calcium sulfonate, 0.09 parts of ethoxylated fatty amine, 0.015 parts of alkyl aromatic triazole, 0.08 parts of alkyl aromatic amine, 0.57 parts of a hydroxythioether, 0.15 parts of the product of Example 2 and 1.40 parts of an amine modified styrene-alkyl maleate copolymer.

As mentioned hereinabove, one advantage of the sulfur-containing polyesters of this invention is their ability to impart wear protective properties to lubricating oil compositions. It is desirable that the improvement in wear protection is not made at the expense of other desirable properties of a lubricating oil composition. Wear protection can be measured by a number of tests, including the Ford Sequence V-D test. This well-known test is described in the "CRC Handbook of Lubrication", Vol. 1, E. Richard Booser, Ed., CRC Press Inc. (1983). It is an eight-day test conducted in 4-hour cycles simulating both turnpike and city driving conditions. Test parameters that are closely controlled include oil, coolant, and inlet air temperatures, coolant flow rate, air-fuel ratio, blowby rate, speed and load. The engine is equipped with a heat exchanger in the blowby system which acts both as a blowby condenser and a reaction chamber to accelerate oil deterioration.

At the test conclusion, the engine is inspected for sludge and varnish deposits using standard rating techniques. Wear measurements are made of the camshaft lobes and piston rings. Weight losses of the cam followers and connecting rod bearing inserts are also determined.

The lubricating composition of Example A was subjected to the Ford Sequence V-D test with the following results:

| | | |
|---|---|---|
| Engine Sludge (10 = Clean) | 9.55 | |
| Engine Varnish (10 = Clean) | 6.92 | |
| Camshaft Lobe Wear | Maximum | 1.6 |
| (Mils (thousandths of an inch)) | Average | 0.95 |

A modified Ford Sequence V-D test wherein the test duration is reduced to 96 hours, and the other test parameters are essentially the same as for the full V-D test, was used to evaluate the performance of the lubricating composition of Example B with the following results:

| | | |
|---|---|---|
| Camshaft Lobe Wear - | Maximum | 0.90 |
| (Mils (thousandths of an inch)) | Average | 0.76 |

It has been surprisingly found that essentially phosphorus-free hydraulic fluids comprising additives of this invention will pass wear tests which previously have required the presence of phosphorus, usually as a zinc salt of a dithiophosphoric acid in the hydraulic fluid employed therein.

What is claimed is:

1. A process for preparing a sulfur-containing polymeric polyester which comprises reacting at least one acid-ester of an alpha-beta unsaturated polybasic acid or functional derivative thereof, wherein said acid-ester contains an average of from about 1 to about 1.3 carboxylic acid groups, with a mixture of a source of sulfur and a mercaptoalkanol of the formula $$HS—(RO)_nH \qquad (I)$$

wherein R is an alkylene group, and n is a number ranging from 1 to about 20.

2. The process of claim 1 wherein the process is conducted in the presence of a catalyst.

3. The process of claim 1 wherein the source of sulfur is elemental sulfur.

4. The process of claim 3 wherein elemental sulfur is present in an amount ranging from 0.5 to about 3 moles, per mole of the acid-ester.

5. The process of claim 1 wherein R contains from 2 to about 8 carbon atoms.

6. The process of claim 1 wherein n is 1.

7. The process of claim 1 wherein the acid-ester is derived from an alpha-beta unsaturated dibasic acid or functional derivative thereof.

8. The process of claim 7 wherein the acid-ester is a maleate monoester.

9. The process of claim 1 wherein the acid-ester has the formula $$R_0(COOR_c)_d \qquad (IX)$$

wherein $R_0$ is a hydrocarbon group characterized by the presence of an ethylenic linkage in an alpha-beta position with respect to at least one ($COOR_c$) group, wherein d is a number ranging from 2 to about 3, and each $R_c$ is independently H, $R_a(OR)_m$, or hydrocarbyl with the proviso that at least one $R_c$ is H and the $(COOR_c)_d$ group contains an average from 1 to about 1.3 groups of formula COOH, and wherein each $R_a$ is independently H or an alkyl or aryl group, each R is independently an alkylene group and each m is independently 0 or a number from 1 to about 20.

10. The process of claim 2 wherein the catalyst is a sulfurization catalyst.

11. The process of claim 9 wherein $R_c$ is an alkyl group containing from about 3 to about 30 carbon atoms.

12. A composition of matter comprising a sulfur-containing polymeric polyester comprising at least 2 repeating units of the formula

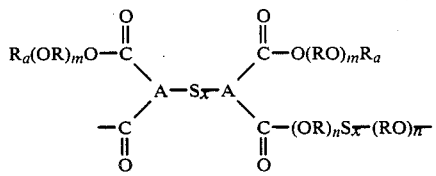

(II)

wherein each A is independently an alkylene group containing from 2 to about 24 carbon atoms, each $R_a$ is independently H or an alkyl or aryl group, each R is independently an alkylene group, each x is independently a number from 1 to about 6, each m is independently 0 or a number from 1 to about 20, and each n is a number ranging from 1 to about 20.

13. The composition of claim 12 which contains from two to about 8 repeating units of formula (II).

14. The composition of claim 12 wherein the polyester contains terminal groups of the formula

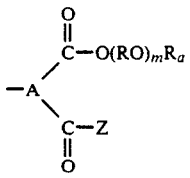

(III)

wherein A is an alkylene group containing from 2 to about 24 carbon atoms, each Z is independently a member of the group consisting of —OH, —NR $R_2$, $(OR)_nS_y(RO)_nH$, or $—O(R—O)_mR_a$, R is an alkylene group, $R_a$ is H or an alkyl or aryl group and $R_1$ and $R_2$ are each independently H or lower alkyl groups, each m is independently 0 or a number from 1 to about 20, each n is independently a number from 1 to about 20, and y is zero or a number from 1 to about 6, or when Z is —OH, a salt may be formed by reaction with a basic, metal containing reagent, ammonia or an amine.

15. The composition of claim 12 wherein each $R_a$ is independently an alkyl group containing from 3 to about 30 carbon atoms.

16. The composition of claim 12 wherein each R independently contains from 2 to about 4 carbon atoms.

17. The composition of claim 12 wherein each x is independently a number from 1 to about 3.

18. The composition of claim 12 wherein each A independently contains from 2 to about 4 carbon atoms.

19. The composition of claim 18 wherein each $R_a$ is independently an alkyl group containing from about 8 to about 24 carbon atoms 20. The composition of claim 12 wherein each R is independently an alkylene group containing from 2 to about 4 carbon atoms, each A independently contains from 2 to 4 about 4 carbon atoms, and each $R_a$ is independently an alkyl group containing from about 8 to about 24 carbon atoms.

21. A process for preparing a sulfur-containing polymeric polyester which comprises reacting a sulfur-coupled acid-ester of a polycarboxylic acid, $$(R_cOOC)_dR_3—S_x—R_3(COOR_c)_d \quad (X)$$

wherein $R_3$ is a hydrocarbon group, each $R_c$ is independently H, $R_a(OR)_m$, or hydrocarbyl, with the proviso that at least one $R_c$ in each $(COOR_c)_d$ group is H, and d is at least 2, wherein each $(COOR_c)_d$ group contains an average of from 1 to about 1.3 carboxylic acid groups, each R is independently an alkylene group, each $R_a$ is independently H or an alkyl or aryl group and each m is independently 0 or a number from 1 to about 20, with at least one member of the group of thiodialkanols of the formula $$H(ORS_xR)_nOH \quad (IV),$$

the formula $$H(OR)_n—S_x—(RO)_nH \quad (V)$$

and the formula $$HO(RS)_nROH \quad (XI)$$

or oligomers thereof, wherein x is a number from 1 to about 6, each R is independently an alkylene group and each n is independently a number from 1 to about 20.

22. The process of claim 21 wherein the sulfur-coupled acid-ester comprises sulfur-coupled monoalkyl esters of dibasic acids.

23. The process of claim 21 wherein each R independently contains from 2 to about 4 carbon atoms.

24. The process of claim 21 wherein x is a number ranging from 1 to about 3.

25. The process of claim 22 wherein the dibasic acid is a succinic acid.

26. The process of claim 23 wherein n is 1 or 2.

27. The process of claim 21 wherein the sulfur-coupled acid-ester has the formula $$(R_cOOC)_dR_3—S_x—R_3(COOR_c)_d \quad (X)$$

wherein x is a number from 1 to about 3, each $R_3$ is a hydrocarbon group, each $R_c$ is H or alkyl, with the proviso that at least one $R_c$ in each $(R_cOOC)_d$ group is H, each d is independently a number ranging from 2 to about 3, with the proviso that each $(COOR_c)_d$ group contains an average of from 1 to about 1.3 carboxylic acid groups.

28. A polymeric composition prepared by the process of claim 1.

29. A polymeric composition prepared by the process of claim 21.

30. A lubricating oil composition comprising a major amount of an oil of lubricating viscosity and a minor amount of the composition of claim 12.

31. A lubricating oil composition comprising a major amount of an oil of lubricating viscosity and a minor amount of the composition of claim 28.

32. A lubricating oil composition comprising a major amount of an oil of lubricating viscosity and a minor amount of the composition of claim 29.

33. A lubricating oil composition comprising a major amount of an oil of lubricating viscosity and a minor amount of a polymeric polysuccinate ester having at least 2 repeating units of formula

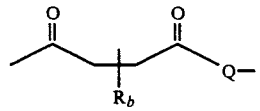

(VI)

wherein each Q is independently $$(OR)_nS_y(RO)_n \quad (VII)$$

or $$(ORS_yR)_nO \quad (VIII),$$

each $R_b$ is independently hydrocarbyl or hydrocarbylthio, each R is independently an alkylene group, each y is independently 0 or a number ranging from 1 to about 6, and each n is a number ranging from 1 to about 20, with the proviso that at least one $R_b$ is hydrocarbylthio.

34. The composition of claim 33 which contains from 2 to about 8 repeating units of formula (VI).

35. The composition of claim 33 wherein each y is independently a number ranging from 1 to about 3.

36. The composition of claim 33 wherein each R independently contains from 2 to about 4 carbon atoms.

37. The composition of claim 33 wherein at least one $R_b$ is an alkylthio group having from about 8 to about 30 carbon atoms.

38. The composition of claim 33 wherein Q is $$(OR)_nS_y(RO)_n \quad \text{(VII)},$$

R contains from 2 to about 4 carbon atoms, n is a number from 1 to about 2, each $R_b$ is an alkylthio group having from about 8 to about 30 carbon atoms, and y is a number from 1 to about 3.

39. The composition according to claim 36 wherein each n is independently 1 or 2.

40. The composition according to claim 33 wherein the polysuccinate ester has a molecular weight ranging from about 1,000 to about 10,000.

41. The composition according to claim 40 wherein the polysuccinate ester has a molecular weight ranging from about 1,000 to about 4,000.

42. A lubricating oil composition containing less than 0.08% by weight of phosphorus, comprising a major amount of an oil of lubricating viscosity and a minor amount of the composition of claim 12.

43. A lubricating oil composition containing less than 0.08% by weight of phosphorus, comprising a major amount of an oil of lubricating viscosity and a minor amount of the composition of claim 28.

44. A lubricating oil composition containing less than 0.08% by weight of phosphorus, comprising a major amount of an oil of lubricating viscosity and a minor amount of the composition of claim 29.

45. The lubricating oil composition of claim 33 wherein the composition contains less than 0.08% by weight of phosphorus.

46. An additive concentrate, for use in preparing lubricating compositions, comprising a substantially inert, normally liquid diluent, and about 1–90% by weight of the composition of claim 12.

47. An additive concentrate, for use in preparing lubricating compositions, comprising a substantially inert, normally liquid diluent, and about 1–90% by weight of the composition of claim 28.

48. An additive concentrate, for use in preparing lubricating compositions, comprising a substantially inert, normally liquid diluent, and about 1–90% by weight of the composition of claim 29.

* * * * *